United States Patent [19]

Cushman et al.

[11] 4,052,290

[45] Oct. 4, 1977

[54] ASPHALT COMPOSITIONS

[75] Inventors: Donald R. Cushman, Wenonah; Charles A. Pagen, Woodbury; John W. Schick, Cherry Hill, all of N.J.; Tsoung-Yuan Yan, Philadelphia, Pa.

[73] Assignee: Mobil Oil Corporation, New York, N.Y.

[21] Appl. No.: 708,803

[22] Filed: July 26, 1976

[51] Int. Cl.[2] ..... C10G 3/00

[52] U.S. Cl. ..... 208/6; 208/3; 208/22; 208/44

[58] Field of Search ..... 208/44, 3, 6, 42

[56] References Cited

U.S. PATENT DOCUMENTS

| | | | |
|---|---|---|---|
| 1,044,175 | 11/1912 | Hennebutte | 208/6 |
| 3,374,104 | 3/1968 | Baum et al. | 208/44 |
| 3,490,586 | 1/1970 | Jaisle | 208/44 |
| 3,970,542 | 7/1976 | Bongertman | 208/44 |

*Primary Examiner*—Veronica O'Keefe

*Attorney, Agent, or Firm*—Charles A. Huggett; Carl D. Farnsworth

[57] ABSTRACT

Improved asphalt compositions are provided which are produced by forming a homogeneous blend of marginal asphalt stock with coal-derived asphaltenes, and air-blowing the homogeneous blend to yield an asphalt composition having a viscosity-penetration index higher than about $2.5 \times 10^5$.

7 Claims, 2 Drawing Figures

ASPHALT COMPOSITIONS

BACKGROUND OF THE INVENTION

Asphalt is an important large volume commodity which is generally derived from petroleum refinery streams such as vacuum residua.

Air-blowing is normally required to increase the viscosity and lower the penetration of the asphaltic material. During the air-blowing process, thermal and oxidative polymerization is effected, and the lower molecular weight resins are converted to asphaltenes.

Continuing research and development efforts have provided a variety of new and improved asphaltic compositions such as are described in U.S. Pat. Nos. 2,395,041; 2,701,213; 2,721,830; 2,767,102; 2,807,596; 2,848,429; 2,894,904; 2,909,441; 3,146,118; 3,264,206; 3,374,104; 3,462,359; 3,476,679; 3,563,778; 3,707,388; 3,725,240; 3,779,964; 3,790,519; 3,810,771; 3,869,417; 3,915,914; and the like.

Recent international economic developments have signaled the inevitable decline of petroleum as the world's supreme industrial commodity. The price of raw petroleum has increased several fold. Also, the consumption of petroleum has been increasing exponentially, and concomitantly the world petroleum supply has diminished to less than several decades of proven reserves.

The economics of upgrading petroleum refining residua into asphalt binders and other high value products is of increasing concern. Attention is being directed to coal-derived liquids as a potential abundant source of asphaltenes.

It was recognized by early workers that coal can be liquified by controlled heating in the substantial absence of oxygen. The conversion products are a liquid and a char. Because of the new compelling economic factors, the technology of coal liquefaction and gasification has been expanding at an accelerated pace. Pioneer developments in the field are represented by Lurgi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

One of the new developments in Fischer-Tropsch technology, i.e., the Sasol process, has been expanded into a commercial venture for converting low grade coal into synthesis gas, and a broad spectrum of organic derivatives such as fuel gas, light olefins, LPG, gasoline, light and heavy fuel oils, waxy oils, and oxygenated chemicals such as alcohols, ketones and acids. A byproduct of the Sasol commercial operation is coal tar.

The prospective advantages of combining coal-derived materials with petroleum-derived materials have not been readily achieved because of the general incompatibility of the two different categories of carbonaceous minerals.

Hence, there remains a pressing need for new technology to alleviate the dependence of industrial nations on petroleum as a critical raw material in energy and chemical applications, and a need for new technology to enhance the efficient conversion of petroleum refinery residua into valuable industrial products.

Accordingly, it is an object of the present invention to improve the economics of upgrading low value refractory petroleum residua into important industrial commodities.

It is another object of the present invention to provide a method for producing homogeneous blends of coal-derived and petroleum-derived materials.

It is another object of the present invention to provide a novel class of asphalt compositions produced from coal-derived carbonaceous material such as Sasol coal tar.

It is a further object of the present invention to improve the air-blowing qualities of marginal asphalt stock.

Other objects and advantages of the present invention shall become apparent from the accompanying description and examples.

BRIEF DESCRIPTION OF THE DRAWINGS

FIG. I is a drawing showing the properties of the base asphalt of Example I compared with the asphalt compositions of Examples 2 and 3 before and after oxidation.

FIG. II is a drawing showing the properties of the base asphalt of Example I compared with the asphalt composition of Example IV before and after oxidation.

DESCRIPTION OF THE INVENTION

Figure 1:
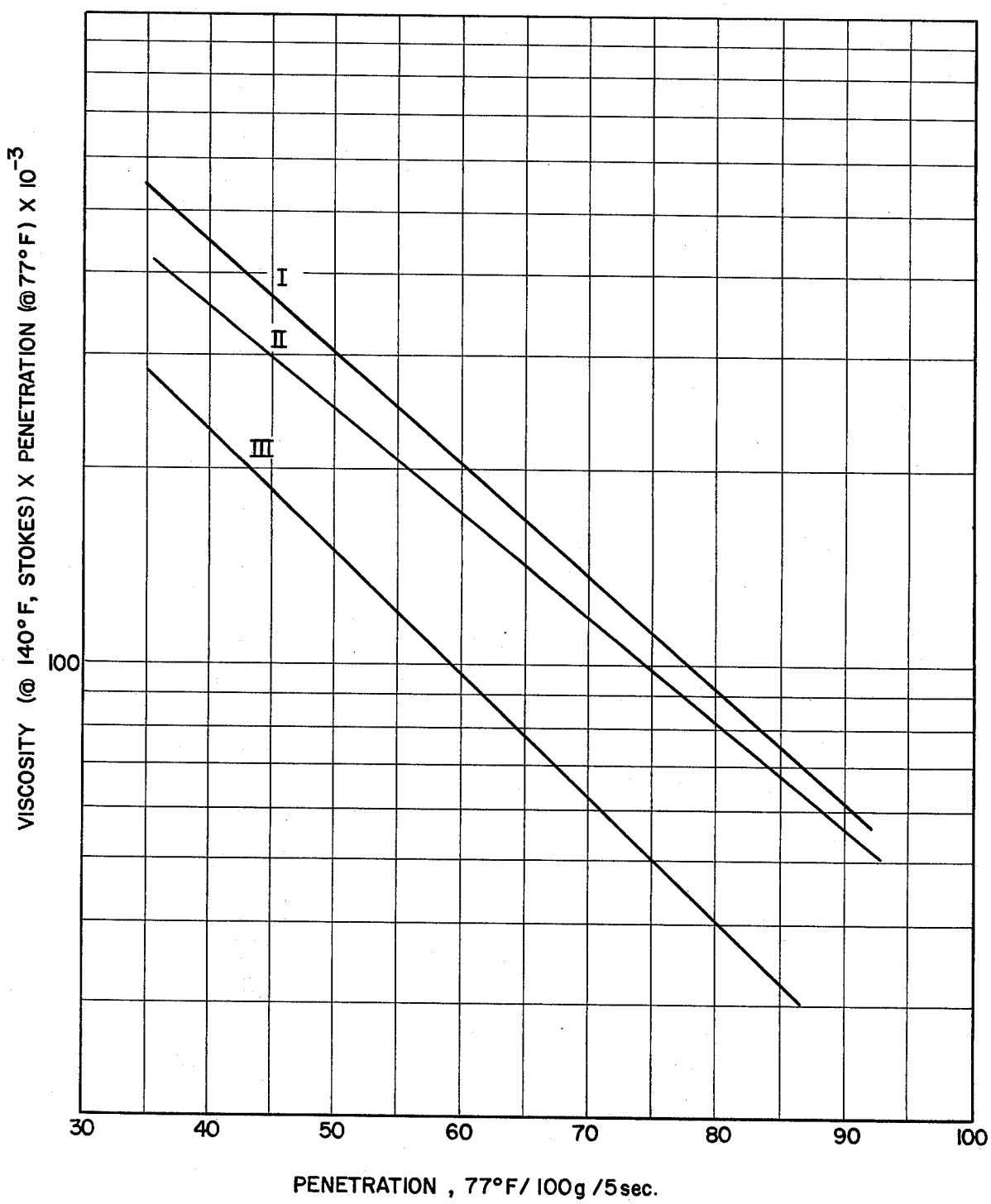

One or more objects of the present invention are accomplished by the provision of a process which comprises admixing and forming a homogeneous blend of coal-derived asphaltenes with a marginal asphalt which has a potential air-blown viscosity-penetration index lower than about $2.5 \times 10^5$, and air-blowing the homogeneous blend to yield an asphalt composition having a viscosity-penetration index higher than about $2.5 \times 10^5$.

By the term "viscosity penetration index" is meant the product of viscosity of asphalt in stokes at 140° F times penetration at 77° F/100 g/5 sec. In some countries, viscosity is measured at 158° F and vis pen is calculated accordingly. As the air-blowing step of the invention process proceeds, the asphalt composition viscosity increases and the penetration decreases. Asphalt stocks which exhibit greater increase in viscosity-penetration index in the blowing process are superior stocks, because a higher viscosity-penetration index value indicates disproportionally greater increase in viscosity (or softening point) than the decrease in penetration.

The quality of an asphalt stock for air-blowing can be evaluated by (1) a comparison of viscosity-penetration index at the same penetration; or by (2) a comparison of the response of the asphalt stock to air-blowing, i.e., the slope of viscosity-penetration index versus penetration $\alpha$, in the equation log (viscosity-penetration) equals $\alpha$(penetration) + $\beta$, or change of viscosity penetration index for each penetration number at 45 penetration, $\gamma$.

The marginal asphalt component of the invention compositions can be any of the various types of petroleum refinery asphalts and natural asphalts which after air-blowing have a viscosity-penetration index lower than about $2.5 \times 10^5$. Marginal asphalts are generally unsuitable as stocks for paving grade binders. Illustrative of typical sources of marginal asphalt stocks are:

A. Petroleum asphalts
  1. Straight-reduced asphalts
    a. Atmospheric or vacuum distillation
    b. Solvent precipitation
  2. Thermal asphalts, as residues from refinery cracking operations
B. Native or natural asphalts
  1. Mineral content below 5 percent a. Asphaltites such as gilsonite, grahamite, and glance pitch b. Burmudez and other natural deposits 2. Mineral content over 5 percent a. Rock asphalts b. Trinidad and other natural deposits There are two kinds of asphalt stocks which are well-known to have poor qualities for air-blowing treatment:

1. Residuum of high hydrogen content, i.e., a low carbon-hydrogen ratio. This type of stock contains higher paraffinic compounds which are difficult to convert to resins and asphaltenes via air-blowing.

2. Short residuum. When more and more valuable distillates are driven off from petroleum crudes, the penetration of residua becomes lower, and eventually straight-run asphalt results. If additional distillates are removed, the resulting short residuum cannot be blown to high viscosity without exceeding the lower limit of penetration.

Asphalts are considered to be colloidal systems in which asphaltenes constitute the dispersed phase and petrolenes the dispersing phase. The petrolenes are defined as that portion of the asphalt which is soluble in 50 volumes of normal pentane per volume of asphalt. Asphaltenes have a high carbon to hydrogen ratio, which indicates a highly aromatic composition. Asphaltenes are believed to have a molecular weight between about 2000 and 10,000.

For the purposes of preparing improved asphalt compositions by the present invention process, the coal-derived asphaltene component of the homogeneous blending operation can be obtained by any of the various coal solubilization and fractionation techniques conventionally employed, e.g., solvent refining of coal.

By the term "solvent-refined" coal is meant any of the purified carbonaceous materials produced by the steps of (1) liquefaction of coal in a highly aromatic or partially hydrogenated aromatic solvent (e.g., tetralin, anthracene, recycle coal oil, and the like); (2) separation of a solvent-rich liquefaction phase from ash and other undissolved solids; and (3) distillation of the liquefaction phase to remove the solvent and volatile components of the solution; and (4) recovery of the high boiling distillation residuum as solvent-refined coal. For road paving and similar applications, optionally the ash and undissolved solids can be maintained in the compositions.

In a typical process, solvent-refined coal is produced by (1) heating a mixture of powdered coal and recycle coal solvent (e.g., a distillation fraction recovered in a coal liquefaction process) at a temperature of about 790° F under a hydrogen pressure of about 1000–2000 psi for a period of about one hour; (2) separating the liquefaction phase from solids by filtration; (3) distilling the liquefaction phase to remove the solvent and volatile components which have a boiling point below about 600° F at standard pressure; and (4) recovering solvent-refined coal which is substantially free of ash and has a much lower oxygen and sulfur content than the original coal starting material. The solvent-refined coal is about 50 percent soluble in benzene (insoluble in pentane) and about 50% soluble in pyridine (insoluble in benzene). Table I summarizes the physical and chemical characteristics of W. Kentucky and Illinois types of coal, and the solvent-refined coal products derived therefrom in accordance with hereinabove described liquefaction process.

The types of solvent-refined coal described in Table I contains about 50 percent by weight of asphaltene components. Table II summarizes the results of a chromatographic separation of solvent-refined coal components. The asphaltenes appear to be a mixture of polar hydrocarbons, indoles and benzofuran derivatives, each of which is substituted with phenyl and/or naphthyl groups.

Another source of coal-derived asphaltenes is from hydrogenated coal products which are produced by liquefaction of coal in the presence of a catalyst and a solvent under high hydrogen pressure at a temperature between about 650° and 750° F. Suitable catalysts include those containing metals such as molybdenum, zinc, magnesium, tungsten, iron, nickel, chromium, vanadium, palladium, platinum, and the like. High temperature, sulfur-resistant catalysts such as molybdenum and tungsten sulfide are preferred.

Coal tar is another excellent source of coal-derived asphaltenes. Preferred coal tars are those having a softening point in the range between about 100° and about 350° F, and a boiling point in the range between about 500° and about 1100° F. The highly preferred coal tars are those having a boiling point in the range between about 600° and about 1000° F. Suitable coal tars are those obtained from the pyrogenous treatment of bituminous material (e.g., coke oven coal tar or pitch), and from high temperature coal conversion processes such as the Lurgi gasification process and the Sasol process.

TABLE I

| | W. Kentucky 14 | | | Illinois #6 | | |
|---|---|---|---|---|---|---|
| | Coal | | | Coal | | |
| | Dry | Dry Ash Free | SRC Product | Dry | Dry Ash Free | SRC Product |
| C | 72.98 | 79.0 | 87.6 | 70.22 | 79.4 | 85.3 |
| H | 5.12 | 5.9 | 4.8 | 4.75 | 5.4 | 5.6 |
| N | 1.33 | 1.4 | 2.0 | 1.42 | 1.6 | 1.8 |
| S | 3.06 | 3.3 | 0.8 | 3.22 | 3.6 | 0.9 |
| Ash | 8.48 | — | 0.7 | 11.57 | — | 1.5 |
| O | 9.03 | 9.8 | 3.4 | 8.82 | 9.9 | 4.3 |
| Coal $C_{100}H_{89}N_{1.5}S_{1.5}O_9$ | | | | Coal $C_{100}H_{89}N_{1.5}S_{1.5}O_9$ | | |
| SRC $C_{100}H_{66}N_{1.9}S_{0.3}O_{2.9}$ | | | | SRC $C_{100}H_{78}N_{1.8}S_{0.4}O_{3.8}$ | | |
| 7800 SCF $H_2$/ton coal | | | | Yield SRC 55% | | |
| 8.5 atoms H/100 C | | | | | | |

TABLE II

FRACTIONS OBTAINED BY LIQUID CHROMATOGRAPHY ON SILICA GEL OF W. KENTUCKY 14 SOLVENT REFINED COAL

| | Oil-like Compounds | | Asphaltenes[1] | | Multifunctional Compounds[2] | | | | |
|---|---|---|---|---|---|---|---|---|---|
| Fraction | #1 | #2 | #3 | #4 | #5 | #6 | #7 | #8 | #9 |
| Eluent | hexane | hexane 15% benzene | $CHCl_3$ | $CHCl_3$ 4% $Et_2O$ | $Et_2O$ 3% EtOH | MeOH | $CHCl_3$ 3% EtOH | THF 3% EtOH | Pyridine 3% EtOH |
| % in SRC[3] | 0.4 | 15 | 30 | 10.2 | 10.1 | 4.1 | 6.4 | 10.2 | 8.5 |

[1]Asphaltenes defined as benzene-soluble, pentane-insoluble compounds.

[2]Multifunctional products defined as pyridine-soluble, benzene-insoluble compounds.

[3]This analysis totals 94.9%, 5.1% of the SRC was not eluted from the column.

In the first step of the present invention process for producing improved asphalt compositions, the marginal asphalt material and the coal-derived asphaltenes are admixed and heated at a temperature in the range between about 200° and 800° F, and preferably in the range between about 300° and 500° F, for a period of time sufficient to provide a homogeneous blend of the marginal asphalt and coal-derived asphaltene components. The heating step is normally conducted for a period of time between about 0.2 and 10 hours, and optionally under pressure and/or in the presence of a reducing gas.

The coal-derived asphaltene component of the asphalt composition is employed in a quantity between about 1 and 50 weight percent, based on the combined weight of the coal-derived asphaltene and the marginal asphalt components in the composition. For most applications, the quantity of coal-derived asphaltenes will vary in the range between about 3 and 30 weight percent.

After the step of forming a homogeneous blend of the marginal asphalt and coal-derived asphaltenes is completed, the homogeneous blend is subjected to a conventional air-blowing treatment to yield the desired asphalt composition having a viscosity-penetration index higher than about $2.5 \times 10^5$.

Air-blowing conditions are described in U.S. Pat. Nos. 2,767,102; 3,462,359; and 3,707,388. In a typical air-blowing procedure, an air rate of about 1.2 to 3.5 cubic feet per hour per pound of charge is employed under atmospheric pressure at a temperature in the range between about 400° F and 800° F.

The following Examples are further illustrative of the present invention. The reactants and other specific ingredients are presented as being typical, and various modifications can be derived in view of the foregoing disclosure within the scope of the invention.

EXAMPLE I

Conventional Asphalt Composition

A base asphalt derived from light Canadian crude was oxidized with air at 325° F for 75 minutes. The composition properties before and after oxidation are listed in Table III. In FIG. 1 provided herein, the vis-pens at 65 and 45 penetration are estimated to be 76,700 and 185,000, respectively. The response of vis-pen to air-blowing as measured by $\alpha$ and $\gamma$ were $-0.0191$ and $-10,117$, respectively.

EXAMPLE II

Invention Asphalt Composition

The same base asphalt as in Example I was admixed with 10 percent by weight of bituminous coal liquefaction derivative, and the admixture was oxidized with air in accordance with the procedure of Example I.

The coal liquefaction derivative employed was a heavy viscous hydrogenated coal oil distillate cut (950° F) obtained by treating finely divided bituminous coal (Illinois No. 6) with coal oil recycle solvent (1 part coal/2 parts solvent) under hydrogen pressure. The hydrogenation was carried out at a temperature of 800°–850° F, a hydrogen pressure of 2000–3000 p.s.i. with a space velocity of 0.5–2 LHSV. The catalyst employed was a currently available cobalt-molybdena alumina catalyst.

The composition properties before and after oxidation are set forth in Table III and FIG. 1. The estimated vis-pens at 65 and 45 penetration were 140,000 and 290,000 (vs. 76,000 and 185,000 for the base asphalt), respectively. The vis-pens of the invention composition were significantly higher than those of the base asphalt composition of Example I.

EXAMPLE III

Invention Asphalt Composition

The same base asphalt as in Example I was admixed with 10 percent by weight of coal tar and the admixture was oxidized with air in accordance with the procedure of Example I.

The coal tar employed was a Bethlehem coke oven tar backing at 650+° F.

The composition properties before and after oxidation are set forth in Table III and FIG. 1. The estimated vis-pens of the composition at 65 and 45 penetration were 165,000 and 360,000 (vs. 76,700 and 185,000 for the base asphalt), respectively. The vis-pens of the invention composition were more than twice those of the base asphalt composition of Example I.

EXAMPLE IV

Invention Asphalt Composition

The same base asphalt as in Example I was admixed with 10 percent by weight of a coal liquefaction bottoms fraction, and the admixture was oxidized with air in accordance with the procedure of Example I.

The coal liquefaction derivative was the 800° F+ bottoms fraction distilled off from the hydrogenated coal material prepared in Example I.

Figure 2:
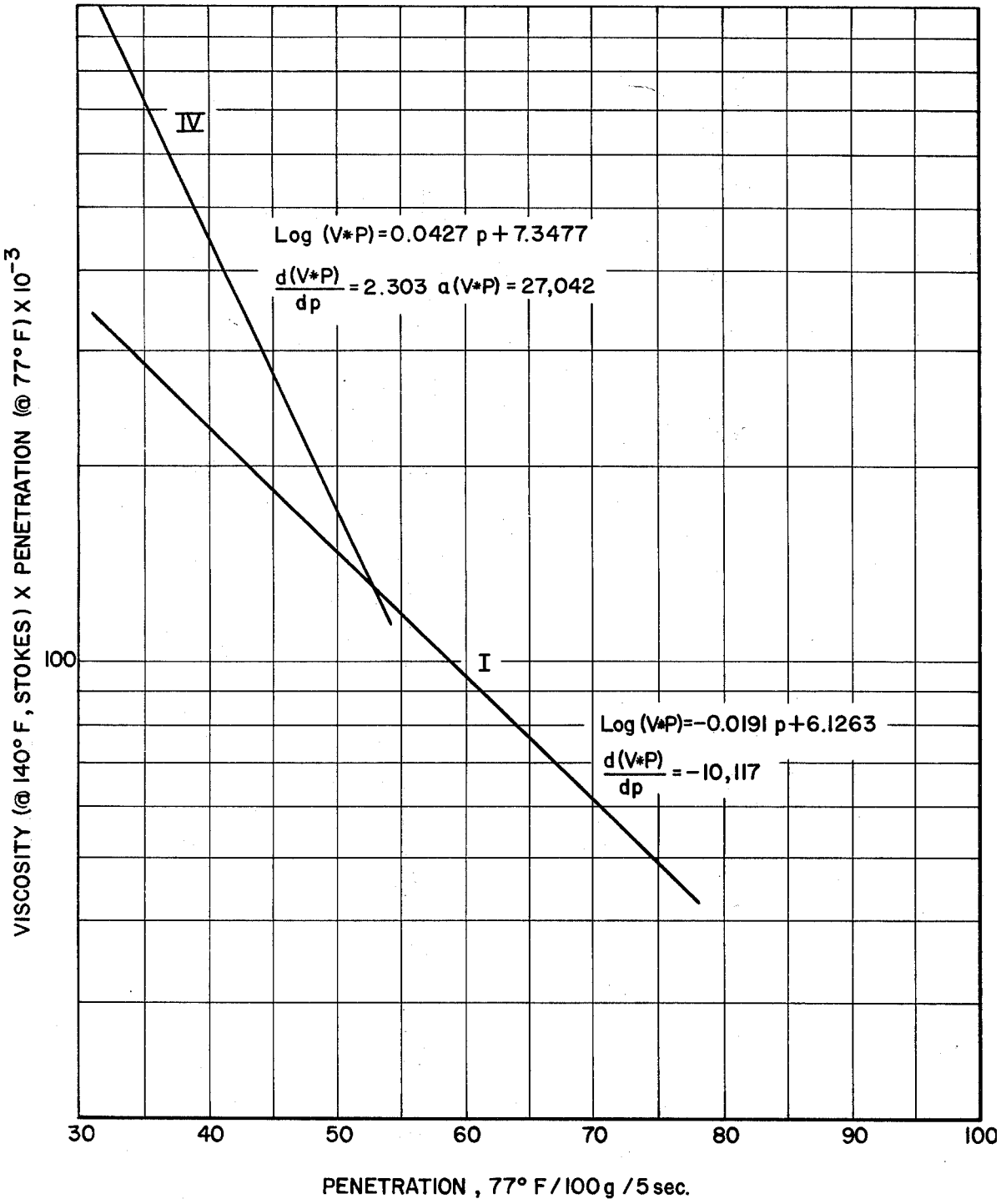

The composition properties before and after oxidation are set forth in Table II and FIG. 2. The results indicated that the sensitivity of the invention composition to air-blowing as measured by $\alpha$ and $\gamma$ was twice that of the base asphalt of Example I.

Table III

| | Oxidation of Asphalt | | |
|---|---|---|---|
| Example | I | II | III |
| Composition | | | |
| Additive | — | Coal Liquefaction Distillate | Coal Tar |
| Additive, % | 0 | 10 | 10 |
| Base Asphalt, % | 100 | 90 | 90 |
| Before Oxidation | | | |
| Viscosity at 140° F, Stokes | 1,180 | 566 | 971 |
| Penetration at 77° F | 65 | 92 | 83 |
| Vis-pen, modified | 76,700 | 52,000 | 80,600 |
| Air Oxidized Product | | | |
| Viscosity at 140° F, Stokes | 5,376 | 10,655 | 6,010 |
| Penetration at 77° F | 41 | 37 | 50 |
| Vis-pen, modified | 220,416 | 394,235 | 300,500 |
| Vis-pen at 65 pen[1] | 76,700 | 140,000 | 165,000 |
| Vis-pen at 45 pen[2] | 185,000 | 290,000 | 360,000 |

[1]Vis-pen at 65 Penetration, see FIG. 1.
[2]Vis-pen at 45 Penetration, see FIG. 1.

Table IV

| | Oxidation of Asphalt | |
|---|---|---|
| Example | I | IV |
| Composition | | |
| Additive | — | Coal Liquefaction Bottoms |
| Additive, % | 0 | 10 |
| Base Asphalt, % | 100 | 90 |
| Before Oxidation | | |
| Viscosity at 140° F, Stokes | 1,180 | 2,029 |
| Penetration at 77° F | 65 | 54 |

Table IV-continued

| Example | Oxidation of Asphalt I | IV |
|---|---|---|
| Vis-pen, modified | 76,700 | 109,566 |
| Air Oxidized Product | | |
| Viscosity at 140° F, Stokes | 5,376 | 29,838 |
| Penetration at 77° F | 41 | 32 |
| Vis-pen, modified | 220,416 | 954,850 |
| Slope, $\alpha$[1] | −0.0191 | −0.0427 |
| Sensitivity, $\gamma$[2] | −10,117 | −27,042 |

[1]Slope in the equation, log (Vis-pen) = $\alpha$(pen) + $\beta$.
[2]Sensitivity in terms of change in vis-pen/pen at 45 pen.

What is claimed is:

1. A process for upgrading asphalt which consists essentially of admixing and forming a homogeneous blend of coal-derived asphaltenes with a marginal asphalt which has a potential air-blown viscosity-penetration index lower than about $2.5 \times 10^5$, and air blowing the homogeneous blend to yield an asphalt composition having a viscosity-penetration index higher than about $2.5 \times 10^5$.

2. A process in accordance with claim 1 wherein the homogeneous blending of asphalt and asphaltenes is conducted at a temperature between about 200° and 800° F.

3. A process in accordance with claim 1 wherein the coal-derived asphaltenes are employed in a quantity between about 1–50 weight percent, based on the total weight of the composition.

4. A process in accordance with claim 1 wherein the asphaltenes are derived from solvent refined coal.

5. A process in accordance with claim 1 wherein the asphaltenes are derived from hydrogenated coal.

6. A process in accordance with claim 1 wherein the asphaltenes are derived from coal tar.

7. An improved asphalt composition produced in accordance with the process of claim 1.

* * * * *

UNITED STATES PATENT AND TRADEMARK OFFICE

CERTIFICATE OF CORRECTION

PATENT NO. : 4,052,290

DATED : October 4, 1977

INVENTOR(S) : DONALD R. CUSHMAN, CHARLES A. PAGEN, JOHN W. SCHICK, and TSOUNG-YUAN YAN It is certified that error appears in the above-identified patent and that said Letters Patent are hereby corrected as shown below:

| | |
|---|---|
| Column 1, line 9 | After "penetration" insert -- number --. |
| Column 4, line 12 | "types" should be -- type --. |
| Column 4, Table II | Underlining under heading "Asphaltenes[1]" should extend from Fractions #3 through #5. |
| | Underling under heading "Multifunctional Compounds[2]" should extend from Fractions #5 through #9. |

Signed and Sealed this

Seventh Day of February 1978

[SEAL]

Attest:

RUTH C. MASON
*Attesting Officer*

LUTRELLE F. PARKER
*Acting Commissioner of Patents and Trademarks*